United States Patent [19]

Wang

[11] 4,376,013

[45] Mar. 8, 1983

[54] PROCESS FOR REMOVAL OF PITCH-CONTAINING WATER AND METHOD OF COATING BELTS FOR PAPER MACHINE

[75] Inventor: Pao-Chi Wang, Strongsville, Ohio

[73] Assignee: The Lindsay Wire Weaving Company, Highland Heights, Ohio

[21] Appl. No.: 311,660

[22] Filed: Oct. 15, 1981

Related U.S. Application Data

[63] Continuation-in-part of Ser. No. 130,215, Mar. 14, 1980, abandoned.

[51] Int. Cl.[3] ..... D21F 7/08

[52] U.S. Cl. ..... 162/274; 162/DIG. 1; 427/393.4

[58] Field of Search ..... 162/199, DIG. 1, 274; 427/390.1, 400; 428/482; 474/268; 423/393.4, 389.9

[56] References Cited

U.S. PATENT DOCUMENTS 3,416,952 12/1968 McIntyre et al. ..... 428/482

3,573,089 3/1971 Tate ..... 162/DIG. 1

FOREIGN PATENT DOCUMENTS 45-16242 6/1970 Japan ..... 162/DIG. 1

*Primary Examiner*—William F. Smith

*Attorney, Agent, or Firm*—Alfred D. Lobo

[57] ABSTRACT

This invention describes a method of treating papermakers' forming and press belts made from polyethylene terephthalate mono or multifilament yarns so that the belts substantially resist the deposition of pitch on the belt yarns while in use in a papermaking machine environment. Pitch-contaminated water and pulp mixtures in contact with the belts are subjected to suction and pressure pulses which remove water from the mixture. The belts are coated with a coating compound which is co-crystalline with the polyethylene terephthalate at the surface of the filament. The coating compound contains a profusion of oxalkylene groups to establish a hydrophilic barrier of active oxyalkyene groups by solvation with water to repel the pitch from the belt and to prevent clogging the belt.

2 Claims, 4 Drawing Figures

PROCESS FOR REMOVAL OF PITCH-CONTAINING WATER AND METHOD OF COATING BELTS FOR PAPER MACHINE

CROSS-REFERENCE TO RELATED APPLICATION

This application is a continuation-in-part application of copending patent application Ser. No. 130,215 filed Mar. 14, 1980 now abandoned.

BACKGROUND OF THE INVENTION

The present invention relates to a process for draining pitch containing water from wet pulp used to make paper. Such a process is carried out in both the forming section and press section of a paper-making machine. In the forming section a forming belt of linear substantially crystalline polyester monofilament is used. In the press section, a felt press belt comprised of non-woven batte on a woven base, also formed from linear substantially crystalline polyester monofilament or multifilament is used. Each belt is foraminous, that is, whether woven or non-woven, each belt has openings which place the upper surface of the belt in open fluid communication with its lower surface. This invention is directed to solving a particular clogging problem which occurs in each belt due to pitch and other oily contaminants which are contained in contaminated water in which pulp is slurried. Such clogging routinely occurs in both the forming section and press section of a paper-making machine and vitiates the efficiency of each belt because clogged openings defeat the process of draining water from the pulp. Thus this invention is more particularly directed to a process of draining pulp through a forming belt in a papermachine, and also through a press belt in a papermachine, with minimum clogging of the belts.

In the paper-making art, wood logs or slabs conventionally are subjected to a series of operations including a grinding or chipping step, followed by pulping with chemicals, bleaching, and suspension of wood fibers in water to form an aqueous pulp slurry containing from about 0.1 to about 2 percent by weight (% by wt) fibers. Such pulp slurry contains impurities, including hydrophobic oily substances, known as pitch, which originates in the wood fibers and remains in the pulp.

Pitch may also be found in a pulp slurry of secondary fibers derived from waste paper. Waste paper pulps are made in equipment which rewets and separates the fiber. Such pitch in a secondary pulp slurry may comprise asphalt-like material used in making corrugated boxes; or, latex, and hot melt adhesives used in cartons and printing papers; or, water-resistant and water-insoluble polymeric substances of all types.

After pulping with chemicals and bleaching, pulp slurry, whether virgin or secondary, or a mixture of each, is pumped to a headbox of an open wire former in the forming section of a paper-making machine, and continuously jetted from the headbox or otherwise deposited onto a woven, endless fine wire screen or 'forming belt' having openings of predetermined size between the machine direction filaments and cross-direction filaments through which openings the pulp slurry is filtered. As a natural, but undesired consequence, some of the pitch is deposited on the surfaces of filaments of the belt and eventually clogs its openings so that the paper-making operation must be interrupted to arduously clean the forming belt. Upon drainage of the water, a sheet of wet paper or "wet web" containing from about 8 to about 25% by wt solids, is formed and retained upon the belt, and as more and more fibers are retained, the fibers themselves act as a filter medium, complicating the analysis and solution of the problem of pits deposition which conventionally eventually causes interruption of the paper making process.

The wet web is led to a press section where more water is pressed out of it by pressing the wet web, supported on an endless felt press belt, between rollers. Sometimes a belt, referred to as a "transfer fabric", may be used after the forming section. A transfer fabric may be either of woven or non-woven or needled batte-on-base manufacture, or a mixture of both. Various configurations of rollers are used in press sections, as illustrated in "Handbook of Pulp and Paper Technology" edited by Kenneth W. Britt, Van Nostrand Reinhold Publishing Company, 2d ed (1970), to produce a pressed web having more than 30% by wt solids content. A press belt may be made from a woven, or a non-woven fabric as described in the chapter titled "Felts", pp 487–495, id, supra.

As long as the belt used, whether the forming belt or the press belt, is made from essentially linear substantially crystalline polyester monofilament or multifilament, the belt attracts and tenaciously holds pitch filtered out or expressed from the pulp and water mixture because the monofilament is strongly hydrophobic. By "essentially linear" is meant that the polyester is either unbranched or exhibits a minor degree of chain branching insufficient to render the polyester insoluble in solvents which dissolve the unbranched polymer. It has been recognized that the hydrophobic nature of the filaments must be negated to ameliorate the problem of clogging due to pitch.

Many mechanisms have been hypothesized for clogging due to pitch, accompanied with suggestions which were acknowledgedly less than successful with respect to copying with pitch deposition. A discussion of this subject in this field of the papermaker's art, is found in "Mechanisms and Control of Pitch Deposition in Newsprint Mills", by L. H. Allen in Papermakers Conference Proceedings, TAPPI pps. 161–162 (1979). This attempt to control pitch by attracting and holding it in the fibers, rather than allowing it to run out with the drainage water, proved impractical.

It was suggested in another reference entitled "Treatments Enhance Forming Fabric Performance" by Ed Hahn, *Paper Age,* pp 20–24 (1979), that both the electrochemical and physical nature of the woven fabric of a forming belt should be modified by chemical treatment. Hydrophilicity of the fabric was regarded as a major property desirable in a functional chemical treatment, but the hydraulic characteristics of the treated fabric were not modified, and there is no disclosure as to what an effective chemical treatment might entail.

In yet another article titled "Forming Fabric Treatment—R&D Pay-Off for Improved Performance" by O. C. Casale in *Paper Age,* pp 36 (1979), it is suggested that a desirable treatment would be based on theories of the interaction of electrochemical properties of stock systems (Zeta potential) with the forming media surface characteristics, but there is no disclosure as to what the treatment is.

Coatings have been adhesively bonded to a forming belt, which coatings were hydrophilic, but such coatings had the disadvantage of flaking off during operation because they were only mechanically or physically bonded to the belt and not bonded to it by co-crystallization. A method for making screen cloths for papermaking is disclosed in U.S. Pat. No. 3,573,089 to Tate in which a water-soluble organic compound having at least two active hydrogen-containing hydrophilic groups is employed so that one of the active hydrogen groups of the hydrophilic substance is condensed by a condensing agent onto the surface of screen cloth, forming a coated film of hydrophilic substance, at least one hydrophilic group remaining, which retains the hydrophilic property. Cross-linking condensing agents are formaldehyde, polyisocyanates and polyamines. This coated film consists of a rigid sheath of cross-linked resin around each wire of the warp and weft and intersections thereof, and this cross-linked resin provides sites for reactive H groups. The cross-linked resin is not co-crystallizable with either a polyamide or a polyester wire. The rigid sheath is formed around a metal screen wire or one made from a synthetic resin, but how the sheath is bonded to the wire will depend upon the composition of the wire and that of the cross-linked resin. The metal wire will be mechanically bonded to the rigid sheath. Nylon wire which is reactive with formaldehyde and polyisocyanates will be chemically bound to the rigid sheath. A polyester wire has no reactive groups at its surface and can only be mechanically bonded to the rigid sheath, like metal and unlike nylon wire, a fact well known in the bonding of tire cords during the manufacture of automobile tires. Accordingly, Tate specifically teaches in his illustrative examples that only metal or nylon wire are coated as he describes. Whether the screen, coated as described by Tate, is metal wire or nylon wire, he states the screen is so stiff that there is no possibility of elongation.

Still other coatings have been adhesively bonded to the belt's filaments without chemically reacting with them, but these, like the Tate coatings mentioned hereinabove, have the disadvantage of being so thick that the openings are significantly reduced in size even before beginning the papermaking operation and such a disadvantage, combined with a rapid pitch buildup, together provide premature clogging.

Also, coatings such as are described in U.S. Pat. No. 4,157,276, containing fluorocarbons, have been used on forming belts which are thus rendered oil repellent in air. Though such materials are known to be resistant to the deposition of hydrophobic materials, such as oil, pitch, and the like, in air, a forming belt, or a press belt so coated with a fluorocarbon is not oil repellent in an acid papermaking environment. The result is premature clogging, long before the belt is sufficiently physically worn out that it must be replaced.

The coating compound used to coat a papermaker's forming belt or felt press belt, so as to provide the novel belt of this invention, has been disclosed in U.S. Pat. No. 3,416,952, for use in the textile industry to coat polyester fibers and imbue them with a characteristic "soil release" or "soil releasant" property. This soil releasant property of a material is distinct from any "soil resistance" property that the same or other material may have. As understood in the textile industry, a "soil resistant" textile material is one which resists the attachment of soil, particularly oils and the like, when the textile such as clothing is worn, or a textile such as a tablecloth or drapery is otherwise used. Whether worn or not, such textiles are used in an atmospheric ("air") environment. The purpose of imparting "soil resistance" to a material is to prevent the attachment of soil in the first place. An example of a soil resistant material is one coated with a fluorocarbon compound such as is currently sold by Minnesota Mining and Manufacturing Company under the trademark "Scothban".

"Soil resistant" textiles are not considered in the textile industry as having a characteristic soil release property, that is, as being "soil releasant", and vice versa. A soil releasant textile, whether worn or not, typically soils as rapidly as the untreated material. The much-touted advantage of a "soil release" treatment of an article is evidenced when the article is washed with detergent in a washing machine. When soaked in water containing detergent, the treated article readily "releases" deposited soil, particularly hydrophobic materials such as oil. In addition, when several soiled articles are together washed in a machine, soil released from one article is not redeposited on another which is deemed soil releasant. Compounds capable of providing a particular fabric with soil release properties are selected for use as a coating depending upon the ability of the compound to co-crystallize with, and not covalently bond to the fabric, as stated in the U.S. Pat. No. 3,416,952, the disclosure of which is incorporated by reference herein as if fully set forth. Particular alkoxylated esters, known for many years and currently sold under the trademarks "Milease T" and "Zelcon" by Imperial Chemical Industries Ltd., and E. I. duPont Co., respectively, are the only available compounds found useful in this invention.

It must be noted that paper-making forming belts and press belts which have been co-crystallized with Milease T or Zelcon "soil release" compounds, generally operate in the acid environment of a papermachine and not in an environment for which these compounds are formulated. As already noted, soil releasant articles are designed to evidence a soil releasant property when the articles are completely immersed in a detergent aqueous medium, after the articles are soiled during wear or use in an atmospheric environment. By contrast, in the present invention, a papermaker's belt is treated with a soil release compound but is used in a primarily papermaking environment so that it exhibits a soil resistant property. Despite exposure of the belts to air and water, rather than immersion in a water bath, contaminated water in contact with the belt fabric provides a barrier through which pitch does not penetrate to attach itself to the fabric.

SUMMARY OF THE INVENTION

A papermaker's woven forming belt, and also a felt press belt of this invention, whether woven or nonwoven, negates the build-up of pitch in openings of the belts for substantially their entire operating lives. It has been discovered that when the polyester filaments of the belt are co-crystallized with a coating compound comprising an alkoxylated ester moiety consisting essentially of a molecule having a hydrophobic "head" portion, and a hydrophilic "tail" portion, which coating compound has a molecular weight of at least 300 and polyoxyalkylene groups linked by groups containing a member of the class consisting of ester and amide linkages, to polyester repeat units which are identical with those repeat units constituting the crystalline segments of the internal structure of the polyester filament, they are attached to the internal structure of the filament by co-crystallization with the crystalline polyester segments of the internal structure, so that the coated filament, when wet, repels pitch. Such a coated filament is represented as having a hydrophobic inner core, and, an outer coating. The outer coating is formed from a profusion of molecules of alkoxylated ester which molecules are co-crystallized through their ester head portions to the filament, the oxyalkylene tail portions being generally freely disposed in spaced apart relationship with the filament. The hydrophilic tail portions together, when wetted, form an aqueous barrier through which pitch and other hydrophobic contaminants do not penetrate.

It is therefore a general object to provide a process for forming a wet web of pulp on a forming belt woven predominantly of a linear substantially crystalline polyester monofilament or multifilament to which an alkoxylated ester is bonded by co-crystallization.

It is also a general object of this invention to provide a novel papermaker's belt, whether woven or nonwoven, formed predominantly of a linear substantially crystalline polyester to which an alkoxylated ester is bonded by co-crystallization.

It is a specific object of this invention to provide a woven forming belt for a papermachine, and a nonwoven or woven felt press belt for a press machine, each belt consisting essentially of a multiplicity of linear substantially crystalline polyester filaments to which a polyalkoxylated ester is bonded by co-crystallization so as to provide soil resistant properties to the belt to such an extent that it does not require cleaning, or cleans easily.

It is also a specific object of this invention to provide a woven belt of polyester filaments coated with a compound having polyester repeat units which are identical with those repeat units constituting the crystalline segments of the internal structure of the filaments, so that the compound is attached to the internal structure of the filaments by co-crystallization in such a way that the warp and weft filaments are not bonded to each other and the stiffness of the coated belt is essentially the same as the uncoated belt.

DETAILED DESCRIPTION OF PREFERRED EMBODIMENTS

Figure 1:
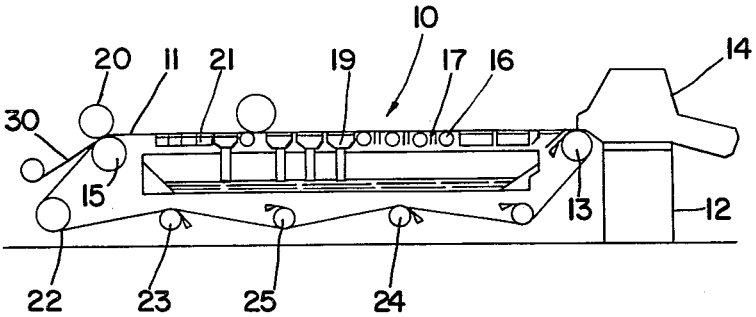
FIG. 1 is a side elevational view diagrammatically illustrating the structure and configuration of a wire forming machine typically used in the forming section of a papermachine.

Referring now to the drawings and in particular to FIG. 1 thereof, there is diagrammatically illustrated the configuration of a typical forming machine in the forming section of a papermaking machine. A forming machine includes a wire former, also referred to as the fourdrinier wire section, indicated generally by reference numeral 10. Other forming machines may include suction breast roll formers, cylinder machines, twin wire formers and variatons thereof, but the following description is particularly directed to a wire former, it being understood that the process of this invention may be used in any papermaking wet process in which an endless belt comprising a major porportion by weight of polyester filament, is subject to clogging due to pitch contained in a pulp slurry. The wire former 10 is so called because the paper-forming fibers in the pulp slurry are deposited on top of an endless wire forming belt 11 running horizontally, with drainage elements positioned under the wire belt. Though it will be evident that the pulp slurry is a "pulp and water mixture", the latter term is also used to define the wet web from the time it commences to form on the wire belt, to the time when the wet web passes through the press section, so as to encompass the wide range of proportions by weight of pulp and water from the front end of the wet section and the back of the press section.

The wire former comprises a rigid structural framework a portion of which includes large side beams 12 for the support of the elements defining the run of the belt. A large turning roll 13 underneath a headbox 14 holding the pulp slurry, at the front end of the former, has a wrap of about 180° and is called the breast roll. The roll 15 at the far end of the wire section is called the couch. The top part of the wire belt between the breast roll 13 and the couch 15 runs in a straight, mostly horizontal run over different types of drainage elements and supporting structures such as are more fully described in the-chapter titled "Paper Machine—Forming Section" in the Handbook of Pulp and Paper Technology, supra, the disclosure of which is incorporated by reference herein as if fully set forth.

Among the drainage elements used there are typically included plain or grooved table rolls 16, single or double deflectors 17, foils (not shown), wet suction boxes 19, and/or dry suction boxes 21, and a lump breaker roll 20 over the couch. As the name implies, the lump breaker breaks lumps of pulp and smooths out the pulp and water mixture on the belt by exerting pressure pulses on the mixture. Suction pulses are applied to the mixture as it passes over the suction boxes to accelerate the removal of water. Thus, in the forming machine, the pulp and water mixture is subjected to both suction and pressure pulses. It will be apparent that water will be removed even if the mixture is not subjected to suction pulses, but very slowly. Between the couch 15 and the breast roll 13 on the lower part of the wire belt, there are return rolls 22, 23, 24, and 25 needed to drive, support, stretch, and guide the belt.

Figure 2:
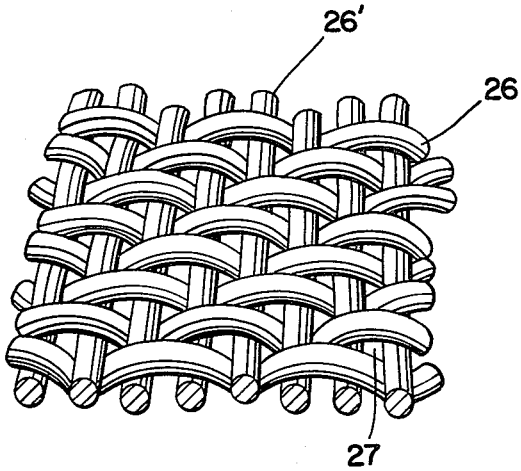
FIG. 2 is an enlarged perspective view, partially in cross section, of a portion of the forming belt of FIG. 1.

As shown in FIG. 2, the belt 11 is predominantly composed of a plurality of machine-direction filaments 26' and cross-direction filaments 26 of polyester monofilament or multifilament woven to provide a plurality of drainage openings 27 having effective diameters as small as about 0.003" if woven with 5 mil yarn, and as large as 0.070" if woven with 30 mil yarn. "Effective diameter" refers to the diameter of a circle having the same area as that of an opening which is defined by the confronting surfaces of adjacent interwoven filaments. The monofilament which is preferred is derived from a linear substantially crystalline polyethylene terephthalate polyester such as is commercially available under the trademark Dacron. By "substantially crystalline" is meant a crystallinity greater than about 80 percent, and preferably greater than about 90 percent. The weave of a forming belt typically ranges from a coarse weave less than about 45 mesh, to a finer weave of more than about 85 mesh, depending upon the paper to be made, the openings 27 being small enough so that most of the fibers in the pulp slurry to be filtered are retained as a wet web 30 on the belt. Since the actual diameter of the filament is in the range from about 0.005" (inch) to about 0.030", it will be appreciated that the problem of clogging can be especially severe even in a medium weave. When the fabric is a non-woven felt such as is used in a felt press belt, the openings are generally smaller, more random and far more convoluted so that the problem of clogging is further exacerbated.

Figure 3:
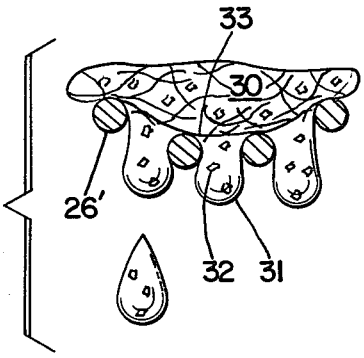
FIG. 3 is a broken-away schematic side elevation cross sectional view, greatly enlarged, diagrammatically illustrating the flow of pitch-containing water through an opening of the woven forming belt; and, FIG. 4 is a side elevational view diagrammatically illustrating the structure and configuration of a press section typically used in a papermachine.

In FIG. 3 there is shown a schematic side elevation cross sectional view, greatly enlarged, to illustrate the flow of a pulp and slurry mixture 30 onto the wire belt, the cross-direction filaments 26 of which are shown in cross section. Contaminated water 31 in which pitch agglomerates 32 are dispersed, flows through the openings in the belt and is aided by suction pulses and pressure pulses generated in the forming machine, the force and frequency of the pulses being varied depending upon the characteristics of the pulp, the speed at which the belt is run, and other considerations. A web of fibers 33 is deposited upon the upper surface of the belt. Though the pitch agglomerates as shown in FIG. 3 are relatively small compared with the effective diameter of the openings between the woven filaments, these agglomerates may acquire much larger dimensions. Depending upon the nature of the pulp slurry, pitch agglomerates may sometimes be so large and of such shape that they are mechanically lodged and intertwined between the filaments, though the agglomerates themselves are actually repelled by the hydrophilic surfaces of the filaments. If such mechanical clogging due to pitch becomes severe, the belt will need to be cleaned, but can be cleaned quite easily.

If a coated filament is viewed on a microscopic scale, it is thought to include an inner core which is the filament composed of hydrophobic crystalline polyester, and an outer coating composed of polymeric chains having hydrophobic "heads" co-crystallized with the hydrophobic inner core. The polymeric chains have at their other ends, hydrophilic "tails" which attract water molecules in the slurry, and, concomitantly with such attraction also repel the hydrophobic pitch agglomerates 32. It is believed that, despite the generally acid environment through which the belt 11 moves, the first aqueous molecules contacting the hydrophilic tails form a hydrophilic barrier, which is spaced apart on a molecular scale from the outer surface of the hydrophobic inner core, and the barrier obstructs penetration of the pitch agglomerates attempting to reach the inner core.

The coating on each filament is provided by applying a stable dispersion of a block or graft copolymer in water, a first polymeric constituent of which is a crystalline polyester and a second polymeric constituent of which is solvated by water. Each filament of the belt is made from a polyester which has repeat units which are chemically identical with the first polymeric constituent of the stable dispersion of copolymer in water.

The bonding of the coating compound to the filaments provides a thin strong coating which not only provides openings of maximum diameter in the belt, but is strongly attached to the hydrophobic core that the coating lasts for the life of the belt. The coating also repels pitch so effectively that it eliminates the need to shut down the forming operation to clean the belt. For example, with the system of the present invention, a test belt ran efficiently for 120 days, which was the life of the belt.

Figure 4:
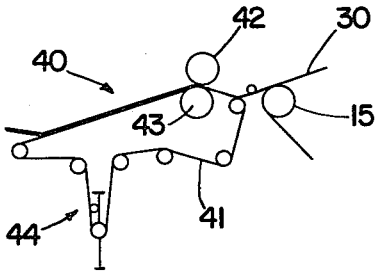

Referring now to FIG. 4 there is schematically illustrated a typical press section indicated generally be reference numeral 40, of a papermachine, and there is shown a felt press belt 41 drivingly trained upon numerous rolls of the press section. The felt press belt is typically a needled non-woven batte on a woven base, such as is depicted in a photograph in the "Handbook" supra, at page 489. The pulp and water mixture (wet web) 30 is shown as it comes off the couch 15, and is deposited on the felt belt 41. The belt and wet web are then together squeezed between a pair of press rolls 42 and 43 so that the water is expressed from the pulp and water mixture due to the pressure pulses exerted by the press rolls. A tensioning mechanism, indicated generally by reference numeral 44, maintains a predetermined tension on the felt belt as it moves between the press rolls and over the other rolls none of which is individually identified. The pulp and water mixture leaving the press section then is led to the dryer section (not shown) of the paper making facility.

It is preferred that the filament be formed from a material which is more than 50% by wt of linear crystalline polyester, and more preferably at least 80% by wt, the most preferred polyester being selected from the group consisting of polyethylene terephthalate, and poly(1,4-bismethylenecyclohexane terephthalate). The surface structure of the coated filaments contains water solvatable oxyalkylene groups as active groups, and the oxyalkylene concentration is in the range from about $0.5\times10^{-5}$ g/cm$^2$ to about $1.5\times10^{-5}$ g/cm$^2$ on the surface of the filaments. The essentially linear crystalline polyester filaments are provided with a surface structure containing at least one oxyalkylene group having a molecular weight of at least 44, said oxyalkylene group being linked by groups containing a member of the class consisting of ester and amide linkages to polyester repeat units which are identical with those repeat units constituting the crystalline segments of the internal structure of the filaments, and which are attached to the inner core of the filaments by co-crystallization with the crystalline polyester segments of the inner core. By water solvatable polymeric group we mean a polymeric group derived from a polyoxyalkylene group which in turn is derived from a glycol having an average molecular weight of at least 62, but more preferably in the range from about 100 to about 6000 inclusive, and the viscosity ratio of the crystallizable polymeric compound, as measured in a 1% solution in orthochlorophenol at 25° C., lies in the range from about 1.0 to about 1.6. Suitable polyoxyalkylene groups include polyoxyethylene, polyoxypropylene, polyoxytrimethylene, polyoxytetramethylene, polyoxybutylene, and copolymers thereof. More preferred is a polyoxyethylene or polyoxypropylene active group which serves to impart hydrophilicity to the surface of the inner core, which active group is derived from about one ethylene glycol or propylene glycol unit to about five such units, and preferably sufficient plural units of either or both gycols to yield a molecular weight in the range from about 300 to about 6000. Further details with respect to the coating compound are disclosed in U.S. Pat. No. 3,416,952 the disclosure of which is incorporated by reference herein as if fully set forth. It is preferred that the belt itself, whether the forming belt or the press belt, be fabricated so that it contains a major proportion by weight, and preferably more than about 90% by wt, of polyester filament.

The most preferred filament diameter for a papermachine belt of this invention is in the range from about 5 to about 30 mils, and when such a belt is woven with a mesh count in the range from about 50 to about 100 mesh in either the machine direction or cross direction, it has substantially the same stiffness as an otherwise identical but uncoated belt. Similarly, the belt of this invention is normally extensible, by which is meant that it is just as extensible during use as is the identical but untreated belt. Further, despite the coating, the filaments in the cross direction are free to move relative to those in the machine direction, to substantially the same extent as the untreated belt. Moreover, the belt of this invention has substantially the same air permeability as that of the uncoated belt. By "substantially the same air permeability" I mean that the air permeability as determined by a Frazier Air Permeability Test is at least 95% of the air permeability of the belt before it was coated. Still further, the belt of this invention is so hydrophilic that water drains through it immediately and has essentially no retention time when poured into a cup-shaped portion of the treated fabric. In contrast, an untreated fabric will hold the water for about 8 to 10 seconds before it will drain through the fabric; and the same fabric when treated as described in Tate's example 2, has a retention time of about 3 to 4 seconds. The foregoing physical characteristics of the belt of this invention derive from the particular co-crystalline attachment of the coating compound to the polyester filament of the belt, and provide easily observable evidence as to the distinguishing characteristics of my belt as compared with prior art belts which are coated with an adhesively bonded coating composition.

EXAMPLE

In the following example there is set forth a particular coating of a forming belt of 72 (machine direction)×50 (cross direction) mesh polyester, 11 mil filament in the machine direction and 12 mil filament in the cross direction, which belt is about 200 inches wide and of arbitrary length.

A treating bath is formulated in a large vat in which the coating compound is preferably present as an aqueous disperson containing 15% solids, which dispersion is present in an amount of from about 1% to about 15% by wt. In a specific example, there is added to the vat: 1055 gals of water, 53 gals of Milease T as received (15% solids dispersed in water), and 3 gals of Triton X405 non-ionic surfactant commercially available from Rohm & Hass Co. In addition, sufficient bactericide is added to prevent degradation of the bath.

The forming fabric is draped into the vat and soaked for from about 1 to about 72 hours after which it is air-dried at ambient temperature. The air-dried fabric is placed on a stretcher and passed over a head roll which is either oil-heated or infra-red heated sufficiently so that the temperature of the fabric is raised in the range from about 250° F. to about 420° F. during a period of about a minute. The heat causes co-crystallization of the coating compound which has polyester repeat units identical with those repeat units constituting the crystalline segments of the internal structure of the filament.

In an analogous manner, a polyester forming fabric is coated with Zelcon 4780 commercially obtained from the E. I. duPont Co.

In each of the above cases, forming belts fabricatd from the coated polyester forming fabric can be run essentially without cleaning for the entire operating life of the forming belt.

Also in an analogous manner as that described hereinabove, a polyester felt press belt fabric is treated with Milease T and Zelcon 4780 and the coated press belts exhibit remarkable repulsion of pitch agglomerates, and if the belts have to be cleaned, are cleaned with ease. A typical felt press belt has a woven base fabric of polyester filament having a diameter in the range from about 7 to about 17 mils onto which base fabric is needled filaments in the range from about 0.5 mil to about 3 mil.

A 1×2 twill fabric woven from a 7 mil polyester monofilament so that the mesh count in the machine direction is 76 and the mesh count in the cross direction is 68, is a typical polyester forming fabric commercially available from Lindsay Wire Weaving Co. as Style 761. When this fabric is treated with a Milease T aqueous dispersion as described hereinabove, the cross direction filaments are free to move relative to the machine direction filaments, and the treated belt is normally extensible, and no stiffer than the untreated fabric.

A portion of the untreated fabric is treated as described in Example 2 of the Tate U.S. Pat. No. 3,573,089, and compared with fabric coated with Milease T.

A standard Frazier Air Permeability test is then conducted with each fabric at 0.5" water pressure drop across the fabric, and the volume of air (in cubic feet per minute) flowing through the fabric is measured. The results are presented hereinbelow in Table I:

TABLE I

| | | |
|---|---|---|
| Untreated fabric | 683 cfm | 100% flow |
| Fabric treated with Milease T | 677 cfm | 99% flow |
| Fabric treated as in Ex. 2 of '089 patent | 632 cfm | 92% flow |

It is evident from the foregoing flow rates that the air permeability of fabric treated with Milease T as described is substantially the same as that of untreated fabric, while that of the prior art fabric is substantially restricted.

The stiffness of the foregoing three fabrics are then compared by taking 1" wide strip (the width being measured in the machine direction of the fabric), and placing portions of the strip between knife edge supports spaced 1.5" and 2.0" apart respectively, and placing a 5 g weight in the center of each strip to obtain a deflection. The smaller the deflection the greater the stiffness. The average reading for each fabric is set forth in Table II hereinbelow:

TABLE II

| | |
|---|---|
| Untreated fabric | 0.0875" |
| Fabric treated with Milease T | 0.115" |
| Fabric treated as in Ex. 2 of '089 patent | 0.0575" |

It is evident from the foregoing that the fabric treated with Milease T as described hereinabove, provides an average deflection which is substantially the same as that of the untreated fabric, the deflection of Milease T treated fabric actually being slightly greater than that of untreated fabric.

I claim:

1. In a forming or press section of a papermachine wherein a pulp and water mixture is deposited on a belt, the improvement wherein a forming or press belt comprises a major amount by weight of a polyester filament provided with a coating containing at least one oxyalkylene group having a molecular weight of at least 44, said oxyalkylene group being linked by groups containing a member of the class consisting of ester and amide linkages to polyester repeat units which are identical with those repeat units consitituting the crystalline segments of the internal structure of the filaments without bonding warp and weft filaments to each other so that the stiffness and air permeability of coated fabric is essentially the same as that of uncoated fabric.

2. A method of coating a polyester filament fabric for use in a papermachine, comprising, contacting said fabric with an aqueous dispersion of a coating compound which dispersion is present in a concentration of from about 1 to about 15 percent by weight, said coating compound containing at least one oxyalkylene group having a molecular weight of at least 44, said oxyalkylene group being linked by groups containing a member of the class consisting of ester and amide linkages to polyester repeat units which are identical with those repeat units constituting the crystalline segments of the internal structure of the filaments, air-drying said fabric at about ambient temperature, training air-dried fabric on a pair of stretcher rolls, and, heating said fabric while on said stretcher rolls to a temperature in the range from about 250° F. to about 420° F. for a sufficient period of time to cause co-crystallization of said compound with said polyester filament without bonding warp and weft filaments to each other so that the stiffness and air permeability of coated fabric is essentially the same as that of uncoated fabric.

* * * * *